US006350020B1

(12) United States Patent
Yoshimura

(10) Patent No.: US 6,350,020 B1
(45) Date of Patent: Feb. 26, 2002

(54) INK JET RECORDING HEAD

(75) Inventor: Manabu Yoshimura, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/026,165

(22) Filed: Feb. 19, 1998

(30) Foreign Application Priority Data

Feb. 20, 1997 (JP) ..... 9-053946

(51) Int. Cl.[7] ..... B41J 2/045
(52) U.S. Cl. ..... 347/71; 347/68; 347/72
(58) Field of Search ..... 347/69, 68, 71, 347/50, 12, 40, 42, 72

(56) References Cited

U.S. PATENT DOCUMENTS 5,625,393 A * 4/1997 Asai ..... 347/69
5,631,680 A * 5/1997 Sugahara ..... 347/69
5,639,220 A 6/1997 Hayakawa ..... 417/53
5,649,346 A * 7/1997 Katsuumi et al. ..... 347/71
5,818,483 A * 10/1998 Mizutani ..... 347/72
5,933,169 A * 8/1999 Sugahara ..... 347/71
5,980,027 A * 11/1999 Yoshimura ..... 347/68

FOREIGN PATENT DOCUMENTS

| | | |
|---|---|---|
| JP | 7-96301 | 10/1995 |
| JP | A-8-112895 | 5/1996 |
| JP | A-8-300650 | 11/1996 |

* cited by examiner

*Primary Examiner*—John Barlow
*Assistant Examiner*—An H. Do
(74) *Attorney, Agent, or Firm*—Oliff & Berridge, PLC

(57) ABSTRACT

An ink jet print head has nozzles and ink passages each communicating with one of the nozzles. The head includes piezoelectric actuators each for changing one of the passages in volume to eject ink from the associated nozzle. The actuators include leading electrodes extending through the thickness of the body of the head. Because the electrodes are exposed in a surface of the body, an actuator drive IC can be connected directly to the head, and therefore the electrical connections of the head can be simple. A process for making the head body includes the step of laminating green sheets together in which predetermined areas are replaced with materials for forming the leading electrodes of actuators, and the step of sintering the laminate.

13 Claims, 11 Drawing Sheets

INK JET RECORDING HEAD

BACKGROUND OF THE INVENTION

1. Field of the Invention

The present invention relates to an ink-jet recording head and a process for making same. In particular, the invention relates to an ink-jet recording head having a body which is a laminate of green sheets made of piezoelectric material. Each of the sheets has films formed in it. At the same time that the sheets are laminated, the films are laminated to form leading electrodes integrally in the head body. The electrodes will be connected to piezoelectric actuators.

2. Description of Related Art

A conventional ink jet printer has ink jet nozzles communicating with ink passages, which can be supplied with ink from an ink supply source. Droplets of ink can be ejected from the nozzles. Printers of such a type have been popular which can be small, which can make high speed recording, and which use on-demand systems, and particularly pressure control systems or bubble control systems by means of heat.

Ink jet printers which use pressure control systems have been made practicable and proposed which use piezoelectric systems with piezoelectric ceramics or other elements.

FIGS. 14–16 of the accompanying drawings show the ink jet head 100 of a conventional ink jet printer using such piezoelectric system. The head 100 includes a body 101, which has ink passages 111 each defined between partition walls 114 made of piezoelectric material. The passages 111 can be supplied with ink from an ink supply source through a manifold. As shown in FIG. 16, an electrode 112 is formed on each side surface of each partition 114. As shown in FIG. 14, a drive IC 107 is formed on a printed board 119. While a drive signal is supplied for a predetermined slight time from the drive IC 107 to the electrodes 112 on the adjoining partitions 114 associated with the passage 111 through which ink should be ejected, these partitions 114 are deformed by shearing strain in such a manner that the passage 111 enlarges in volume to be replenished with ink. When the deformed partitions 114 return to their original shape, ink is ejected from the passage 111 out through the nozzle 110 at the front end of the passage.

The head body 101 also has leading electrodes 105 formed on its top to feed the electrodes 112 of the actuators each formed for one of the passages 111. The leading electrodes 105 are connected electrically through a flexible print circuit (FPC) 115 to terminals of the wiring pattern 116 of the drive IC 107.

The leading electrodes 105 are exposed, and each has a width of tens of microns and a thickness of several or some microns. Therefore, when the recording head 100 is assembled, or when it is mounted on a carriage for moving it, the electrodes 105 are liable to come off the head body 101 and break.

The FPC 115 includes a number of signal conductors, which corresponds to the number of leading electrodes 105. Therefore, the electrical connections between the FPC 115 and the electrodes 105 and between it and the terminals of the wiring pattern 116 are complicated. In order to prevent the ink ejected from the nozzles 110 from sticking to the pattern 116 and the drive IC 107, it is preferable that the printed board 119 be protected with resin or the like. If the board 119 is thus protected, however, the heat generated in the IC 107 cannot radiate well.

Japanese Patent application Laid-Open No. 8-112895 discloses an ink jet head, which includes an actuator plate.

The plate has first channels formed in it in parallel for ejecting ink. The plate also has second channels, which extend perpendicularly to the first channels and in parallel to their side walls. Each of the second channels communicates with one of the first channels. Formed on the side walls of each first channel are first electrodes, to which actuator drive voltage can be applied. Formed on the side walls of each second channel are second electrodes (ejection channel lead wires), which are connected electrically to the first electrodes.

U.S. patent application Ser. No. 08/635,655 filed Apr. 22, 1996 discloses an ink jet print head, which includes an actuator plate. A leading pattern for a driver circuit is formed on a board, which is bonded to the actuator plate. The body consisting of the board and the plate has a number of channels formed in it, some of which serve as ink chambers. The partitions between the channels function as actuators. For use as a drive electrode, a conductive film is formed on part of each side surface of each partition by oblique vapor deposition and electroplating in such a manner that it is connected electrically to the leading pattern. The film extends on both the board and the plate. Therefore, voltage can be applied directly from the driver circuit to the drive electrodes.

SUMMARY OF THE INVENTION

It is an object of the invention to form integrally in the body of an ink jet print head a plurality of leading electrodes each for connection to the electrode of a piezoelectric actuator, and thereby protect the leading electrodes.

It is another object to simplify electrical connections in an ink jet print head and the mounting of a drive IC on the head body.

It is a further object to make efficient the heat radiation from the drive IC of an ink jet print head.

In accordance with a first aspect of the invention, an ink jet print head is provided, which includes a body having nozzles. The body also has ink passages formed in it to be filled with ink. The passages each communicate with one of the nozzles. The head also includes piezoelectric actuators each for changing the volume of one of the passages to eject ink from the associated nozzle. The actuators have leading electrodes extending through the thickness of the body.

As stated above, the leading electrodes of the actuators extend through the thickness of the head body perpendicularly to the ink passages. This prevents the electrodes from being damaged or broken when the print (recording) head is assembled or mounted on a carriage. One end of each leading electrode is exposed to the outside of the head body. Therefore, a drive circuit for the actuators can be connected directly to the exposed ends of the electrodes. Consequently, the IC chip including the circuit can be mounted directly on the body. This simplifies the structure of the head, and particularly its electrical connections, and accelerates the radiation of heat from the chip through the body.

The print head may further include second leading electrodes embedded in the head body for connecting the drive circuit to an electric system outside the head. The ends of the second electrodes may be exposed to the outside of the body. In this case, one end of each second leading electrode can be connected to the actuator drive circuit, and the other can be connected to wiring for supplying the circuit with data signals, a drive voltage, etc. It is therefore possible to simplify the electrical connections between the head and an external circuit, and between the drive circuit and the external circuit.

In accordance with a second aspect of the invention, an ink jet printer is provided, which comprises a print head and a device for supplying the head with ink. The head includes a body having nozzles. The body also has ink passages formed in it to be filled with ink. The passages each communicate with one of the nozzles. The head also includes piezoelectric actuators each for changing the volume of one of the passages to eject ink from the associated nozzle. The actuators have leading electrodes extending through the thickness of the body.

As stated above, the leading electrodes of the actuators extend through the thickness of the head body. This prevents the electrodes from being damaged or broken when the print (recording) head is assembled or mounted on a carriage. It is possible to make the head compact, thereby making the printer small. It is also possible to reduce the printer trouble or failure due to wiring breakage or the like.

In accordance with a third aspect of the invention, a process is provided for producing a print head for ejecting ink through nozzles by means of piezoelectric actuators. The process comprises the steps of:

laminating green sheets together in which predetermined areas are replaced with materials for forming leading electrodes for the actuators;

sintering the laminated sheets to form a sintered body;

polarizing the sintered body; and forming ink passages in the sintered body, the passages each communicating with one of the nozzles.

This process includes laminating the green sheets to form the piezoelectric sintered body. Those areas of the sheets, where the leading electrodes are programmed to be formed, are replaced in advance with the materials for forming these electrodes. Therefore, the laminating and sintering of the sheets connect the materials across the thickness of the sheets, forming the electrodes extending across the sheet thickness. The process makes it possible to produce, with high accuracy and ease, a print head having a body through which the leading electrodes of piezoelectric actuators extend.

The process may also comprise the step of mounting on the print head a circuit for driving the head in such a manner that the circuit is connected to those ends of the leading electrodes which are exposed to the outside of the sintered body. Because of the electrode ends exposed in a surface of the sintered (head) body, it is easy to mount directly on the body the IC chip including the circuit for driving the head.

The process may further comprise the step of forming electrodes for driving the piezoelectric actuators on the side walls of the ink passages in such a manner that the driving electrodes are each connected to one of the leading electrodes.

The ink passages may each take the form of a channel. The process may further comprise the step of fitting a cover plate on the sintered body in such a manner that the plate covers the passages. The plate may be another sintered body. The two sintered bodies may be polarized in the opposite directions. The plate may have channels formed in it and each facing one of the channels in the head body (see FIG. 13).

BRIEF DESCRIPTION OF THE DRAWINGS

Preferred embodiments of the invention are shown in the accompanying drawings, in which.

DETAILED DESCRIPTION OF PREFERRED EMBODIMENTS

Figure 1:
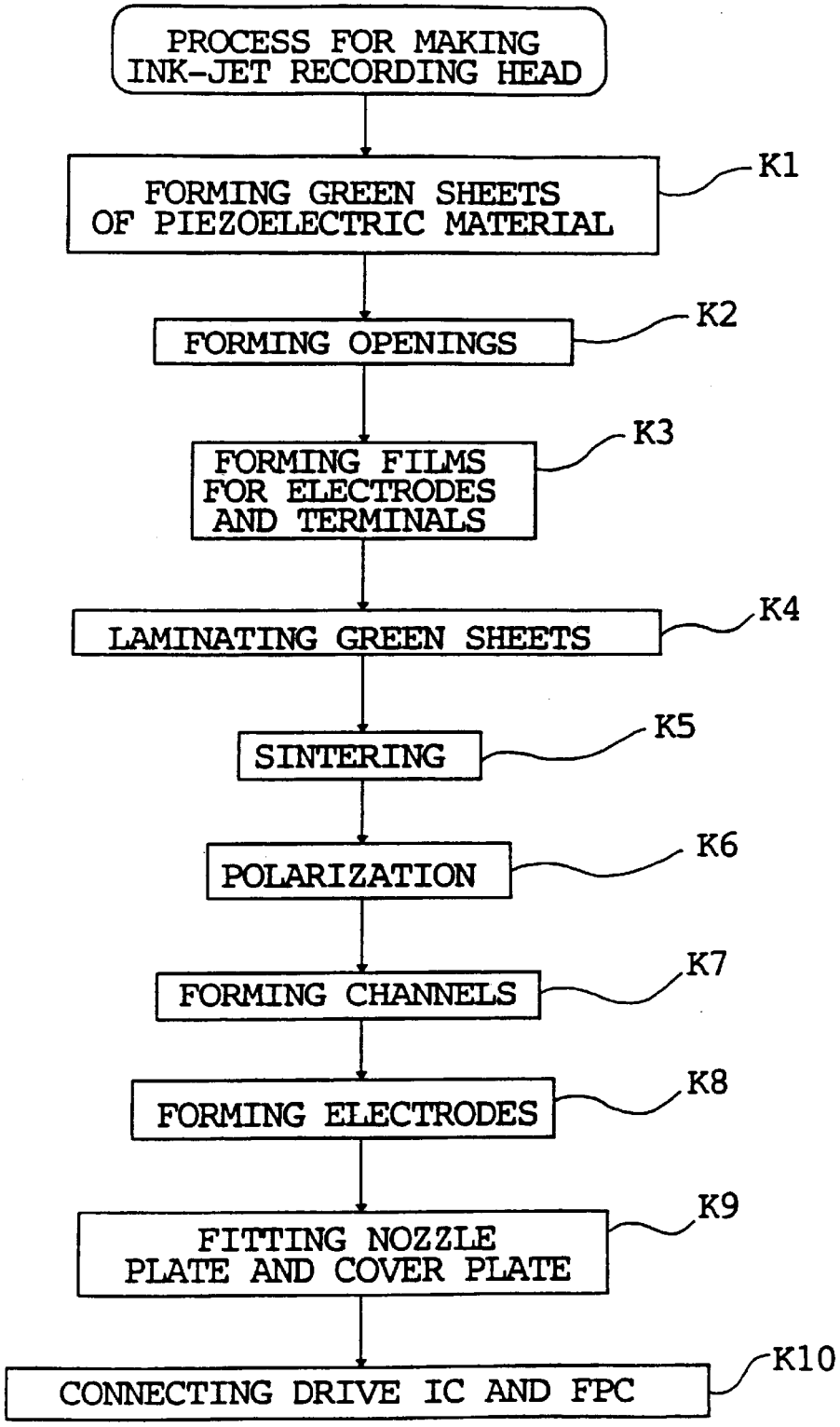
FIG. 1 is a flow chart of a process for making an ink-jet recording head according to the invention.

Ink-jet recording heads according to the illustrated embodiments each have sets of ink jet nozzles, ink passages and piezoelectric actuators incorporated therein. The nozzles are positioned at the front ends of the heads. FIG. 1 shows a process according to the invention for making such a head.

Figure 2:
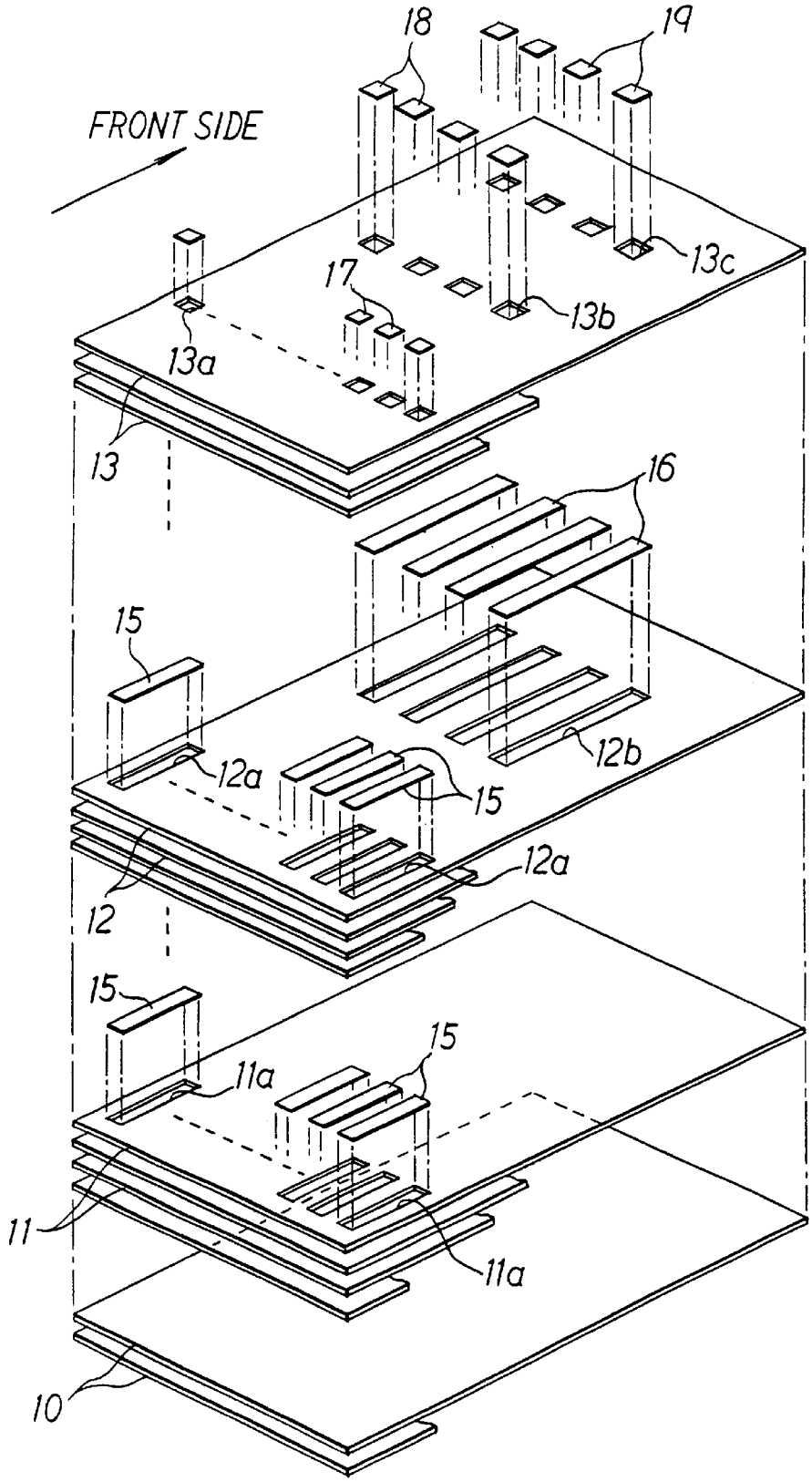
FIG. 2 is an exploded perspective view of a laminate of green sheets for an ink-jet recording head according to the invention.
Figure 3:
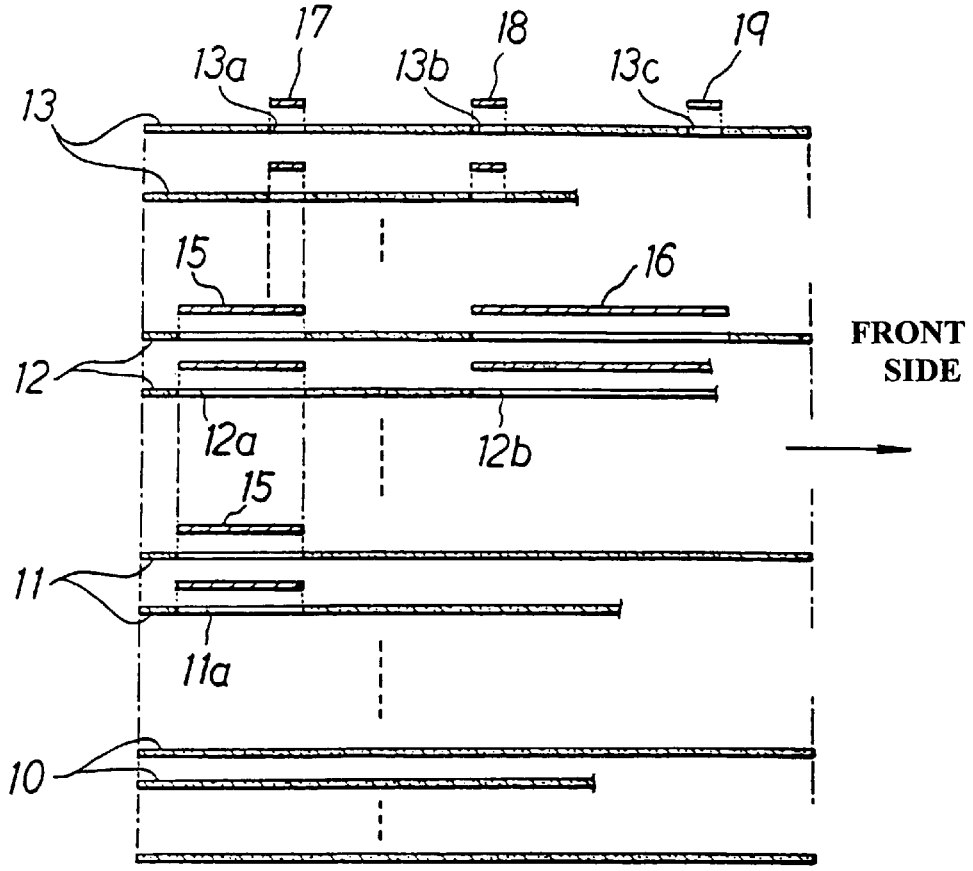
FIG. 3 is an exploded vertical cross section of the laminate.

First step K1 of the process includes adding small amounts of organic binder, plasticizer, dispersant, etc. to pre-burnt piezoelectric ceramic powder to form slurry, forming the slurry into a thick film which has a thickness of tens of microns by means of a film forming apparatus, and cutting the film into green sheets 10–13 which have a predetermined size, as shown in FIGS. 2 and 3.

Second step K2 includes forming a number of openings 11*a* through a rear end portion of each lower green sheet 11 at regular intervals in a line across the sheet width. Step K2 also includes forming openings 12*a* likewise through a rear end portion of each upper green sheet 12. The openings 11*a* and 12*a* extend longitudinally of the sheets, and have a predetermined length and a width of tens of microns. Step K2 further includes forming a number of openings 12*b* through each sheet 12 at regular intervals in a line across the sheet width. The openings 12*b* extend longitudinally of the sheets, and have a predetermined length and a width of tens of microns. Step K2 yet further includes forming openings 13*a,* 13*b* and 13*c* through each top green sheet 13 at regular intervals in line across the sheet width. The openings 13*a,* 13*b* and 13*c* extend longitudinally of the sheets. The openings 13*a* have a predetermined length and a width of tens of microns. The openings 13*b* have a predetermined length and a width of tens of microns. The openings 13*c* have a predetermined length and a width of tens of microns. The openings Ha are each aligned with one of the openings 12*a* and one of the openings 13*a*. The openings 12*b* are each aligned with one of the openings 13*b* and one of the openings 13*c*.

Third step K3 includes forming an electrically conductive film 15 in each of the openings 11*a* of the lower green sheets 11 and the openings 12*a* of the upper sheets 12, by rubbing a metal paste on the sheet with a spatula or knife through a mesh sheet (not shown) blinded except its portions corresponding to the openings. The paste contains a fine powder of platinum or other metal dispersed in a resinous liquid. Step K3 also includes forming an electrically conductive film 16 likewise in each opening 12*b* of the upper green sheets 12. Step K3 further includes likewise forming an electrically conductive film 17 in each opening 13*a* of the top green sheets 13, an electrically conductive film 18 in each opening 13*b* of these sheets 13, and an electrically conductive film 19 in each opening 13*c* of the sheets 13. The conductive films 15–19 are equal substantially in thickness to the green sheets 10–13.

Figure 4:
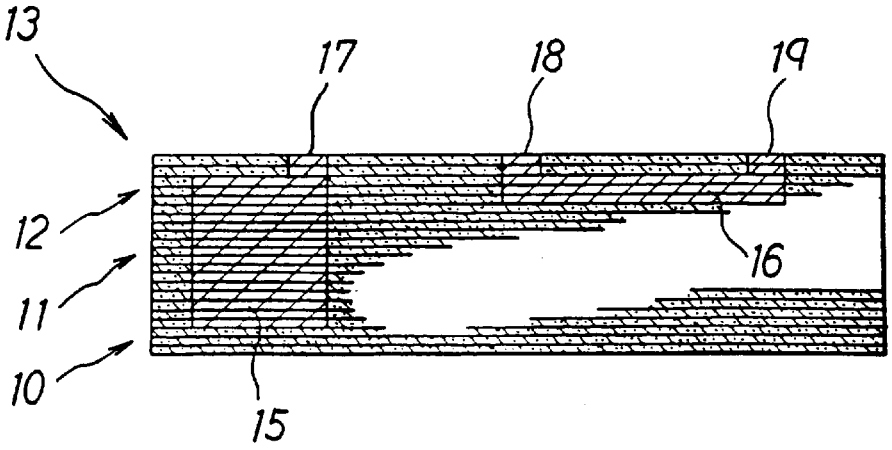
FIG. 4 is a vertical cross section of the laminate.

As shown in FIG. 4, fourth step K4 includes laminating the green sheets 10–13 together in that order, with the adjacent conductive films 15 and 17 laminated together, and with the adjacent conductive films 16, 18 and 19 laminated together. Step K4 also includes heat-sealing the sheets 10–13 together to form a green laminate.

Fifth step K5 includes removing the binder from the green laminate by heating the laminate to a temperature of about 400 centigrade to thermally crack all the organic components contained in the laminate. Step K5 also includes sintering the heated laminate by reheating it at a temperature of about 1,000 or more centigrade.

Figure 5:
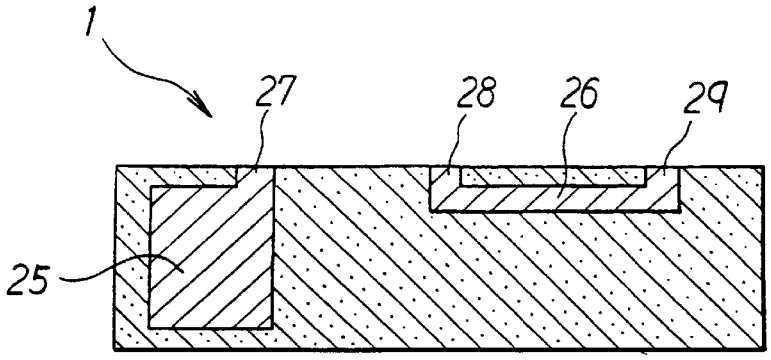
FIG. 5 is a vertical cross section of the body of the head.

This, as shown in FIG. 5, forms a head body 1 made of piezoelectric ceramic which is a sintered body. At the same time, this forms in the body 1 first leading electrodes 25 each by joining associated conductive films 15 of the green sheets 11 and 12 together, and first terminals 27 each by joining associated conductive films 17 of the top green sheets 13 together. The electrodes 25 are each joined to the associated terminal 27. This also forms in the body 1 second leading electrodes 26 each by joining associated conductive films 16 of the upper sheets 12 together, second terminal s 28 each by joining associated conductive films 18 of the top sheets 13 together, and third terminals 29 each by joining associated conductive films 19 of the sheets 13 together. The electrodes 26 are each joined to the associated terminals 28 and 29. The terminals 27 29 are exposed outside the body 1.

In sixth step K6, for polarization in the upward direction 38 (FIG. 8), a high DC voltage is applied between the top and bottom surfaces of the head body 1.

Figure 6:
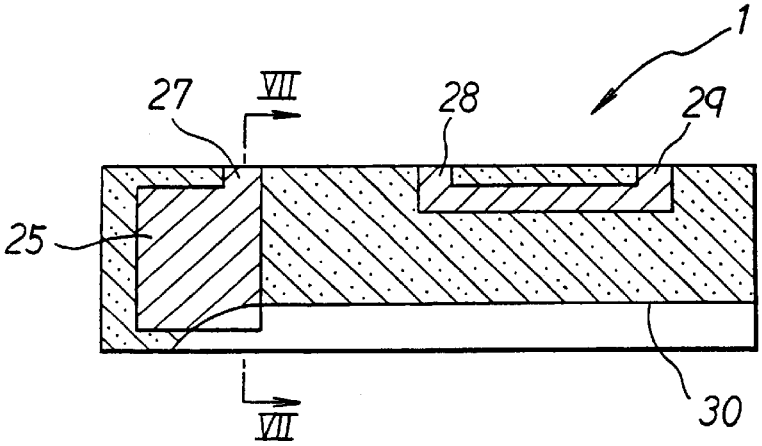
FIG. 6 is a vertical cross section of the head body in which channels are formed.
Figure 7:
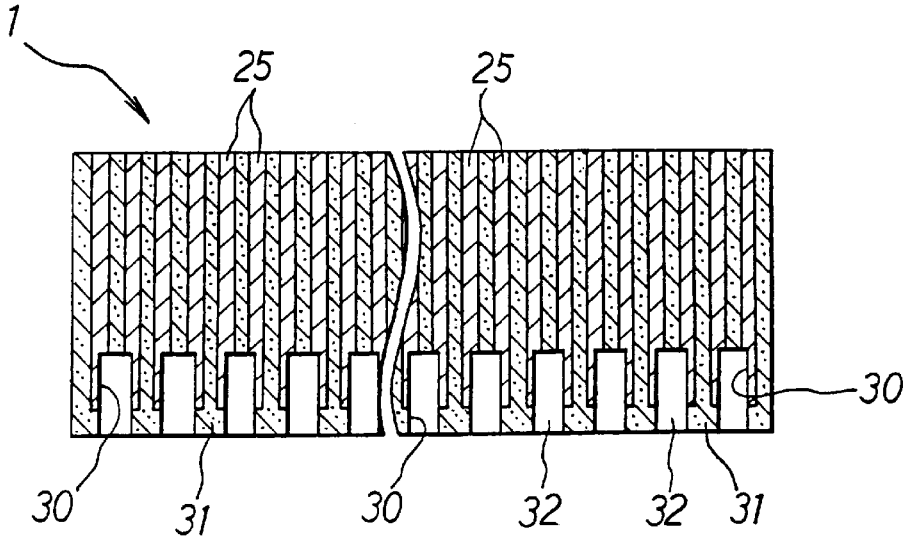
FIG. 7 is a cross section taken along line VII—VII of FIG. 6.

In seventh step K7, as shown in FIGS. 6 and 7, a channel cutter (not shown) is used to form narrow longitudinal channels 30 at regular lateral intervals in a bottom portion of the head body 1. The channels 30 each extend between the front end of the body 1 and adjacent two of the first leading electrodes 25. Each of the channels 30 is wider than the space between the adjacent electrodes 25, and formed with the opposite surfaces of these electrodes cut partially. As shown in FIG. 7, the formation of each channel 30 exposes bottom portions of the associated electrodes 25 in its side walls. The channels 30 are partitione d by partition walls 31. Every other channel 30 except both end channels serves as an ink passage 32.

Figure 8:
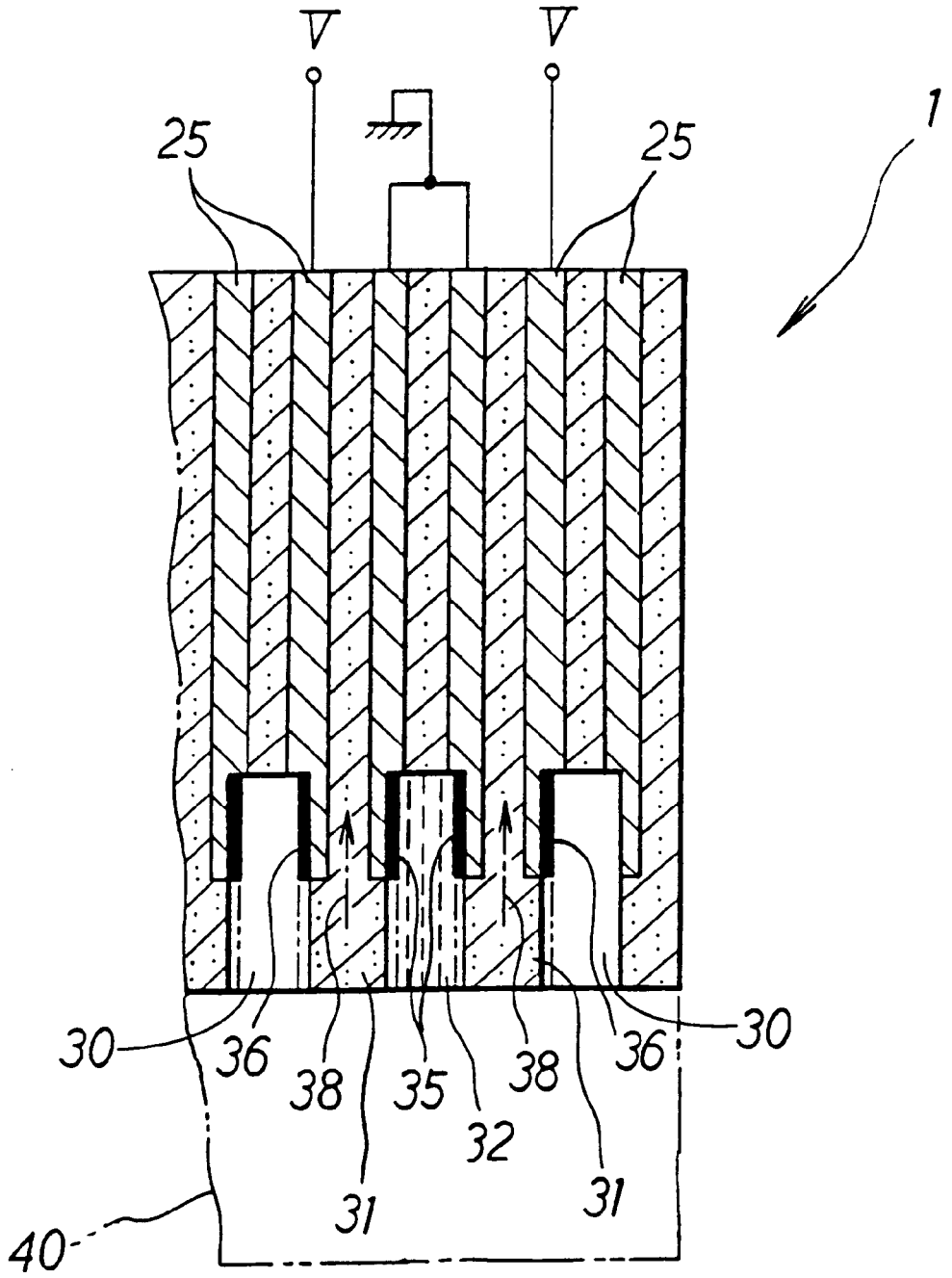
FIG. 8 is an enlarged view of part of FIG. 7, but showing the head body on which actuator electrodes are formed.

As shown in FIG. 8, eighth step K8 includes masking the lower halves of both side surfaces of each partition 31 with masking seals as shown by the two-dot chain lines. Step K8 also includes depositing platinum or another metal on the upper halves of the half masked wall surfaces to form an electrodes 35 or 36 on the upper half of each partition 31. Each of the electrodes 35 and 36 is connected by itself to the bottom portion of the adjacent first leading electrode 25, which is exposed to the associated channel 30. Step K8 further includes removing the masking seals thereafter.

The electrodes 35 on the side walls of the ink passages 32 are each grounded through the associated leading electrode 25. A drive voltage V can be applied to the other electrodes 36 on side walls of the other channels 30 each through the associated leading electrode 25. The partitions 31, the electrodes 35 and 36 on them, etc. constitute piezoelectric actuators.

Figure 9:
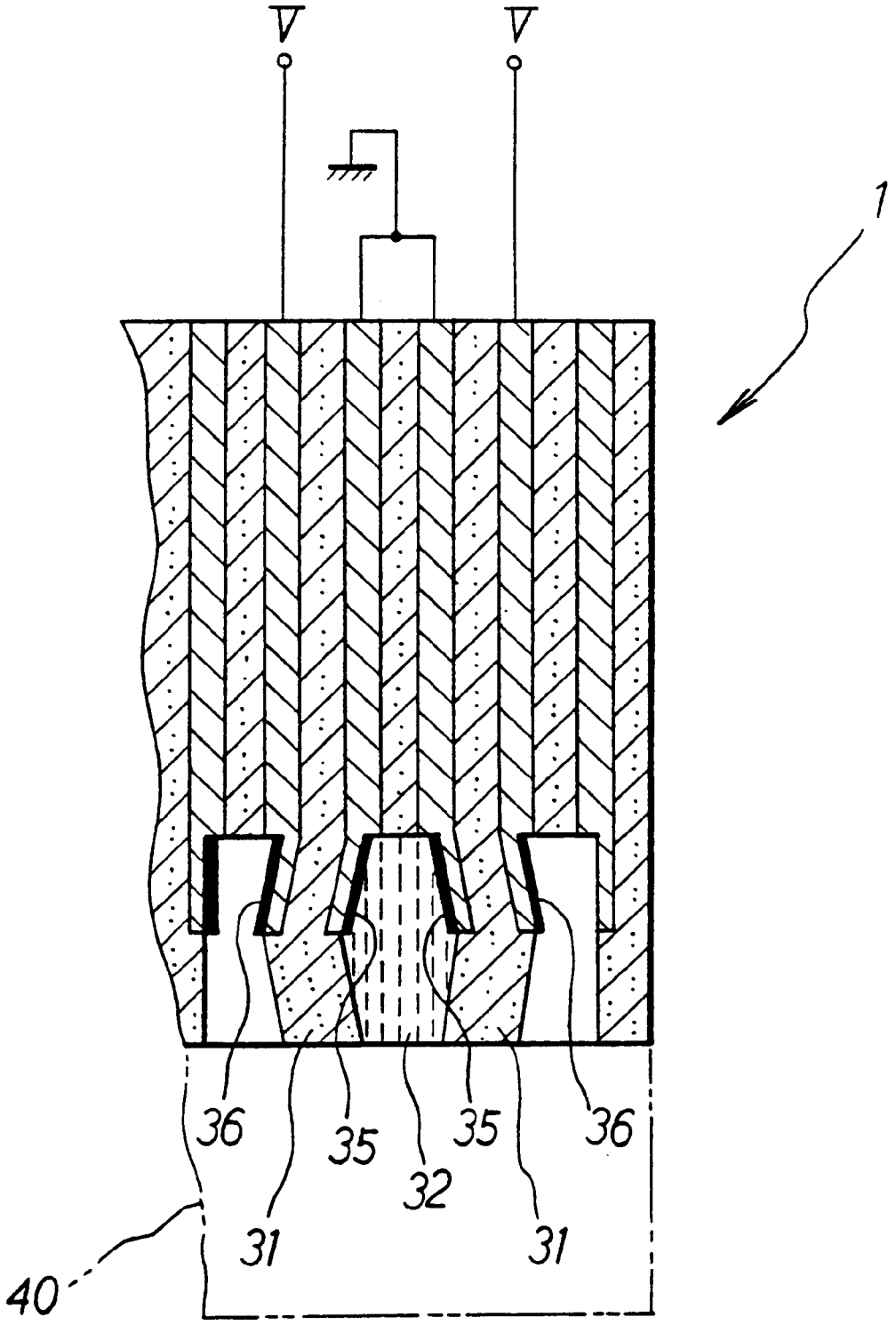
FIG. 9 is a view similar to FIG. 8, but showing the head body of which partition walls have shear-deformed.
Figure 10:
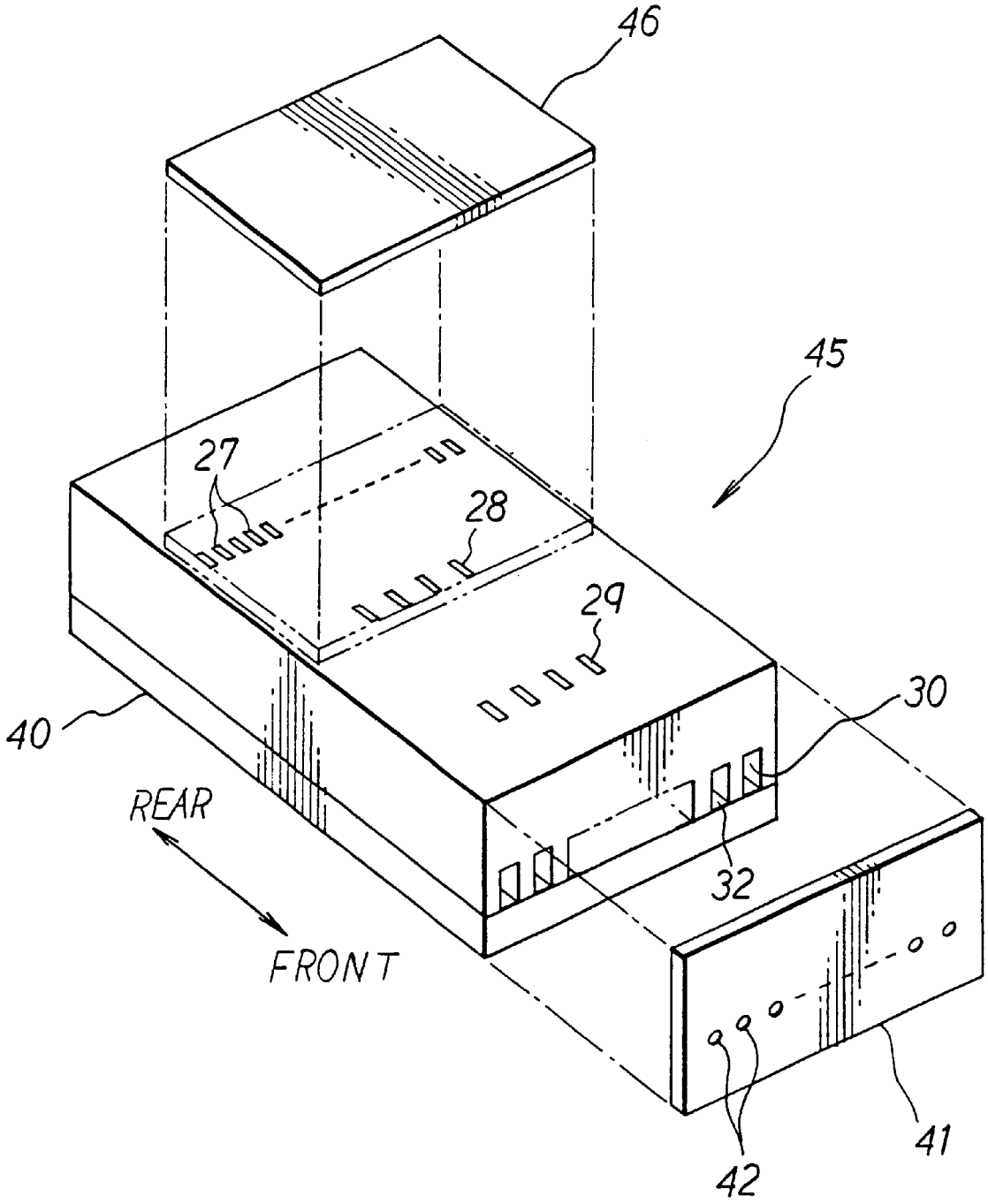
FIG. 10 is an exploded perspective view of the head.
Figure 11:
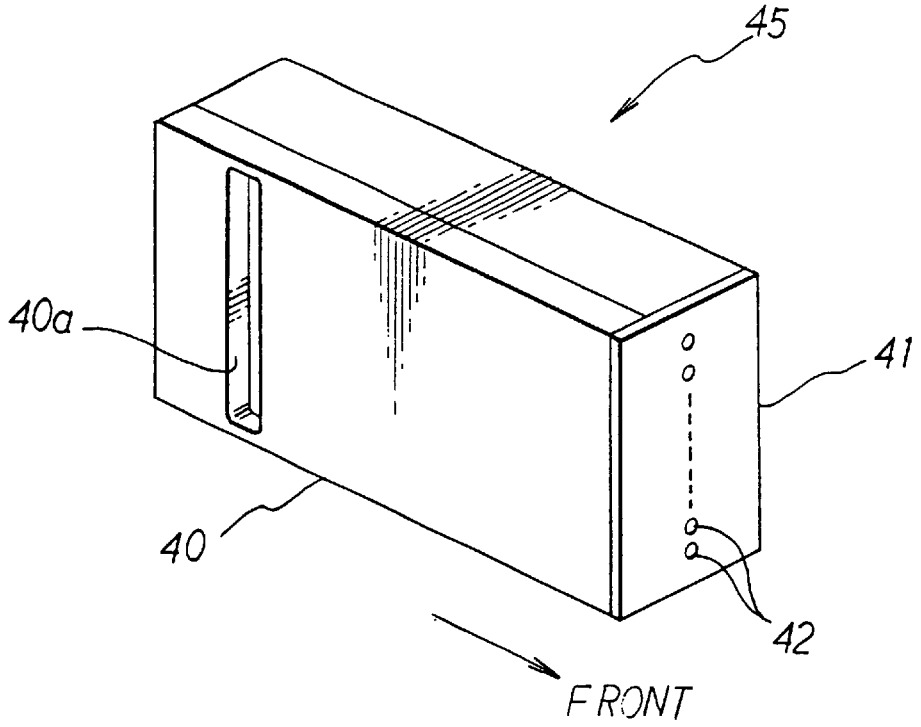
FIG. 11 is a perspective view of the head.

As shown in FIGS. 9 and 10, ninth step K9 includes bonding a cover plate 40 to the bottom of the head body 1 to cover the channels 30. Step K9 also includes bonding a nozzle plate 41 to the front end of the body 1. The plate 41 has ink jet nozzles 42 formed through it and each aligned with one of the ink passages 32. This can make a recording head 45 which has sets of ink jet nozzles 42, ink passages 32 and piezoelectric actuators incorporated in it. As shown in FIG. 11, the cover plate 40 has a lateral slot or opening 40a formed through its rear portion to supply ink to the passages 32. A manifold or ink supply member (not shown) can be fitted to the slot 40*a* to connect the head to an ink cartridge (not shown).

Figure 12:
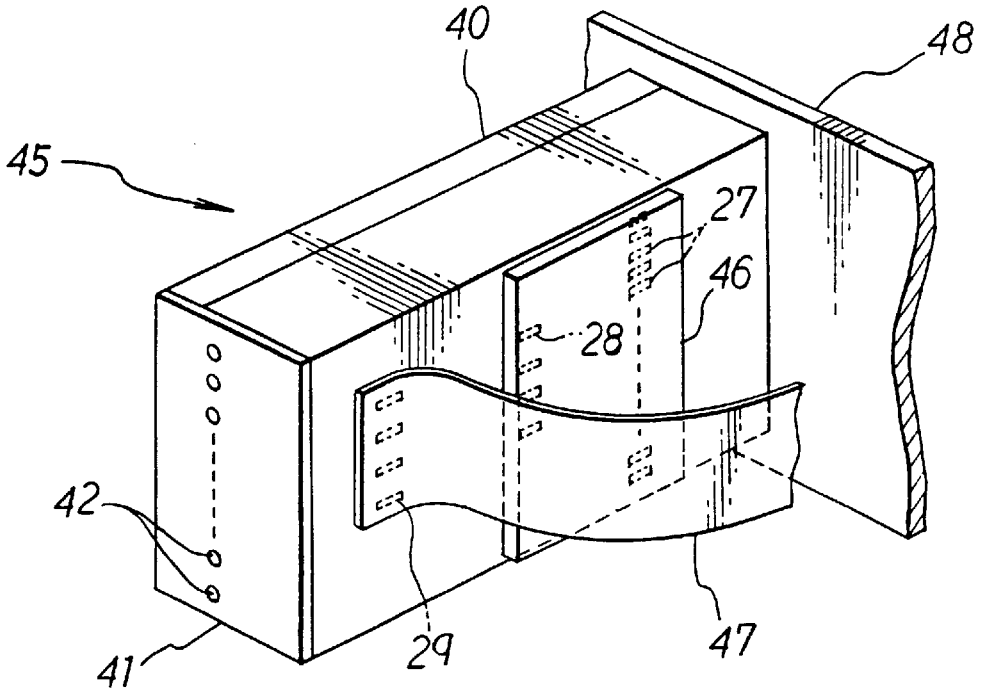
FIG. 12 is a perspective view of the head fitted to a printed board.

As shown in FIG. 10, tenth step K10 includes mounting a drive IC 46 on the top of the head body 1 with an adhesive or the like, and at the same time brazing the output and input terminal areas of the IC 46 to the first and second terminals 27 and 28, respectively. The IC 46 can supply the drive electrodes 36 with drive signals. As shown in FIG. 12, step K10 also includes brazing the third terminals 29 to one end of an FPC (flexible print circuit) 47. It is then possible to mount the recording head 45 as a unit on a carriage (not shown) by fitting the rear end of the head 45 to a printed board 48 with an adhesive or the like, and connecting the other end of the FPC 47 to the wiring pattern (not shown) formed on the board 48.

The FPC 47 includes a clock signal conductor, a data signal conductor, a voltage conductor and a ground return. In synchronism with the train of clock pulses supplied through the clock signal conductor, the IC 46 judges which nozzles 42 ink should be ejected through, from the data appearing on the data signal conductor, and applies to the associated drive electrodes 36 the voltage on the voltage conductor.

When, as shown in FIG. 9, the drive voltage V is applied from the drive IC 46 to the electrodes 36 on the two partitions 31 on both sides of one of the ink passages 32, the upper halves of these partitions 31 shear-deform away from each other perpendicularly to the direction 38 of polarization (which is shown in FIG. 8). As a result, the middle of each of the two partitions 31 shifts away from the other, expanding the passage 32. This replenishes or refills the passage 32 with ink from an ink supply source (not shown). When the voltage application to the electrodes 36 is stopped, the two partitions 31 are released from the shear deformation and return to their original positions. This ejects ink from the passage 32 out through the associated nozzle 42.

Figure 13:
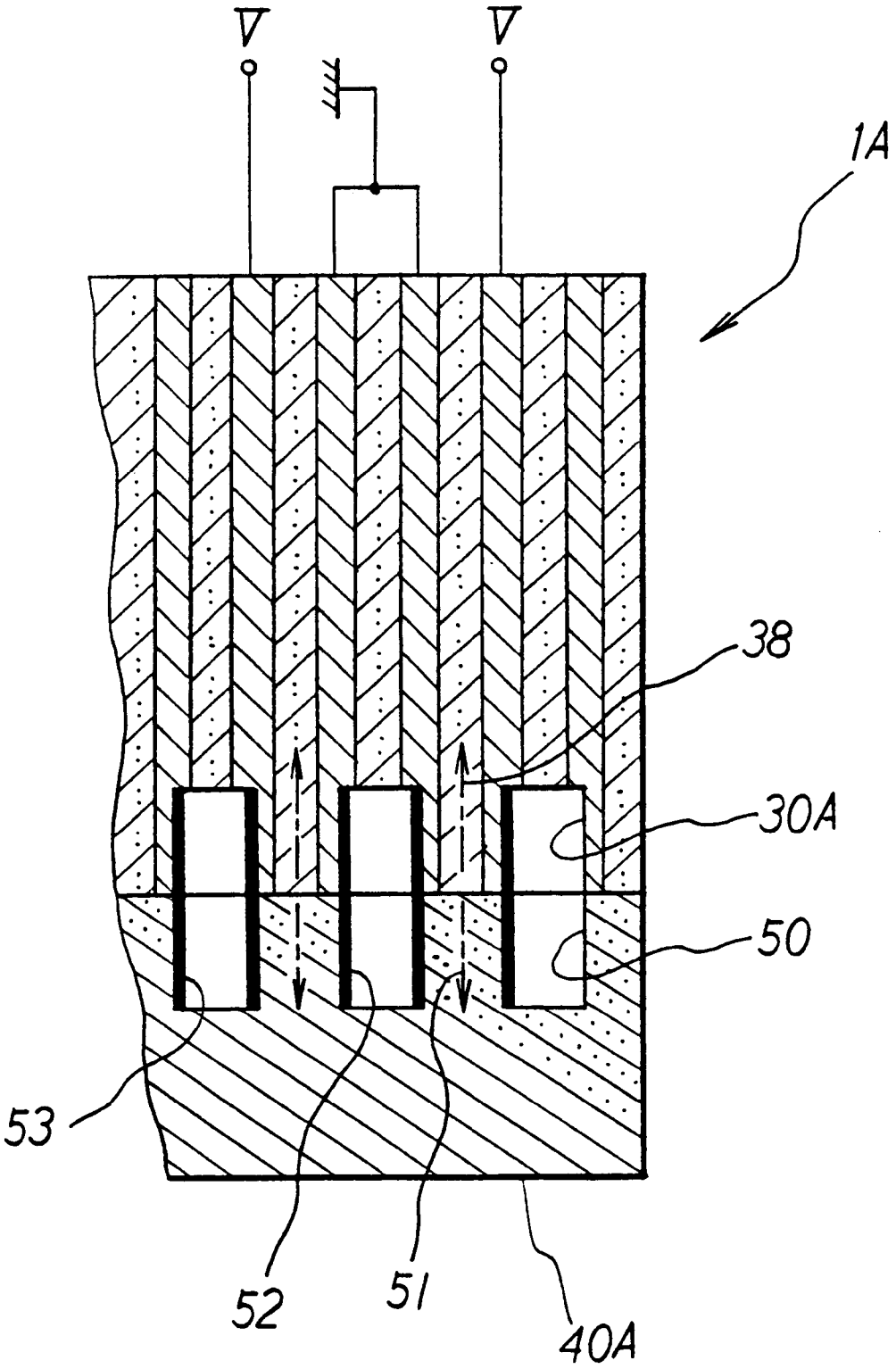
FIG. 13 is a partial vertical cross section of the body of a modified ink-jet recording head according to the invention.
Figure 14:
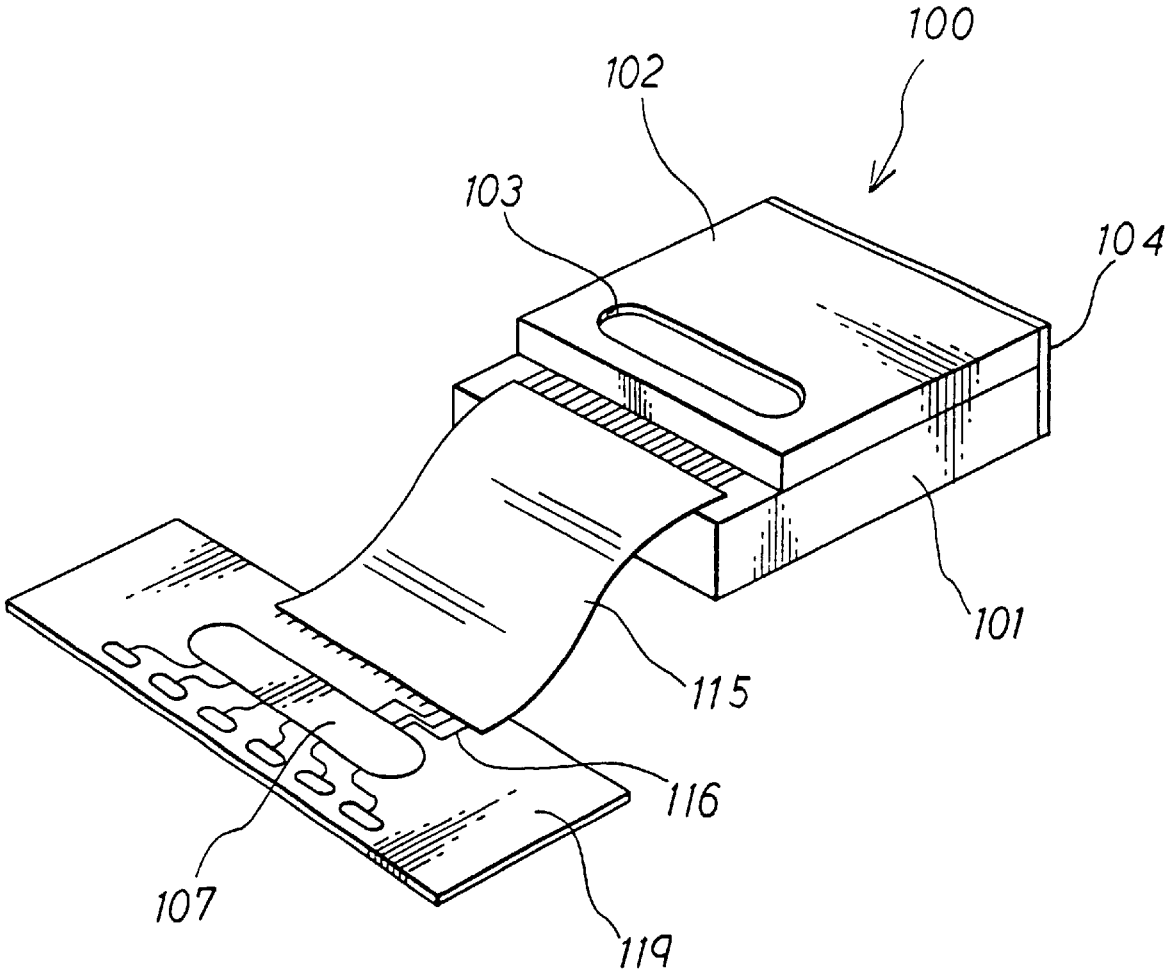
Fig. 14 PRIOR ART
FIG. 14 is a perspective view of a conventional ink jet head.
Figure 15:
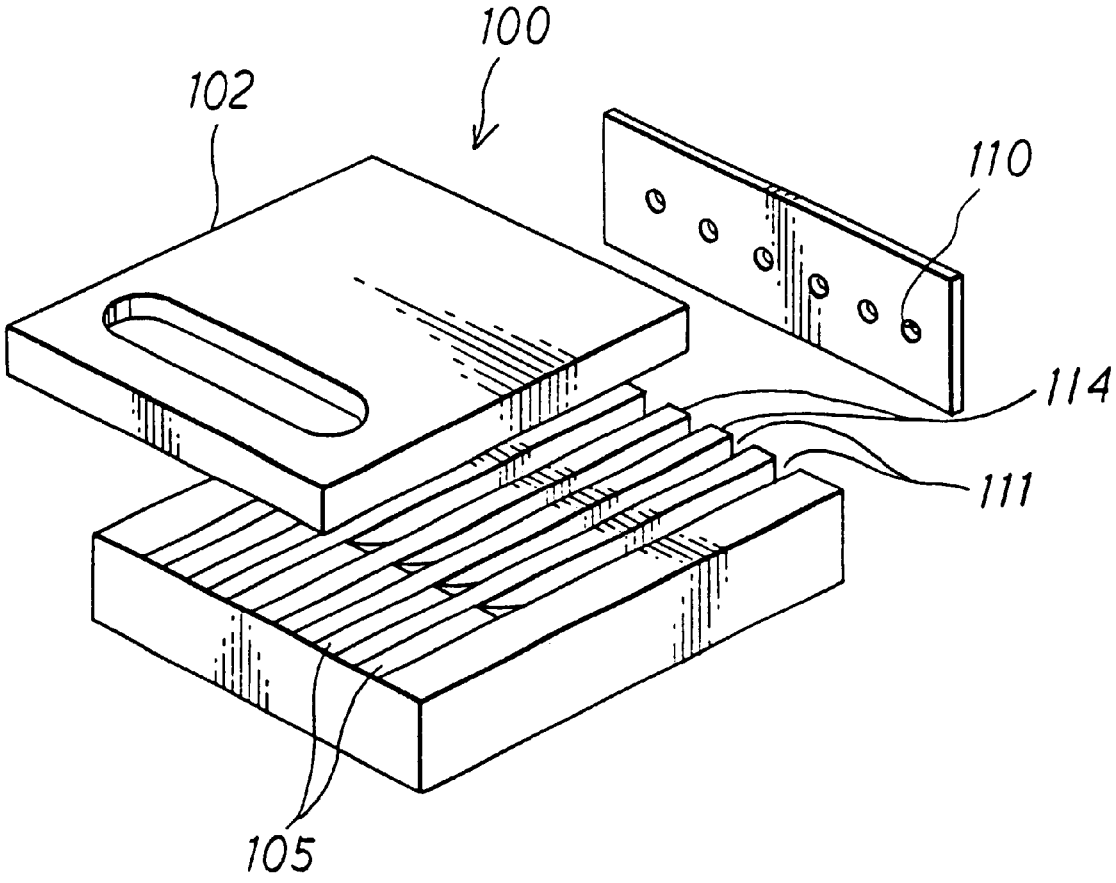
Fig. 15 PRIOR ART
FIG. 15 is an exploded view of the conventional head.
Figure 16:
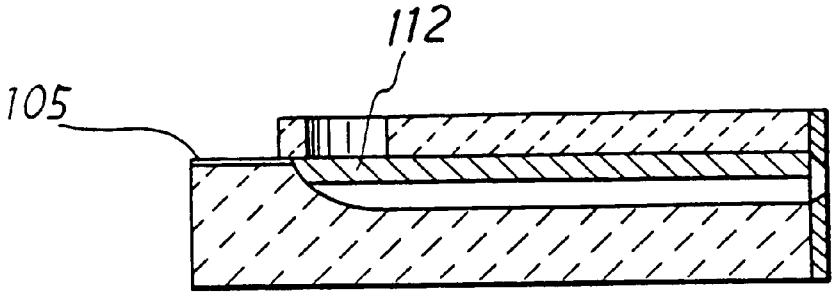
Fig. 16 PRIOR ART
FIG. 16 is a cross section of the conventional head.

FIG. 13 shows a modified ink-jet recording head according to the invention, which includes a head body 1A having narrow bottom channels 30A formed in it. Fixed to the bottom of the body 1A is a cover plate 40A, which is formed out of green sheets laminated together and sintered. The plate 40A has narrow top channels 50 formed in it and each aligned with one of the body channels 30A. The body 1A and the plate 40A are polarized in the opposite directions 38 and 51, respectively. Electrodes 52 and 53 extend over the channels 30A and 50. The electrodes 52 are grounded, and a drive voltage V can be applied to the other electrodes 53. Such structure can double the efficiency of ink ejection and reduce the electric power consumption.

As stated above, the green sheets 10–13 of piezoelectric material are laminated together to form the head body 1. The films 15 are formed in the sheets 11 and 12, and each equal in thickness to each of the sheets. When the sheets 10–13 are laminated, associated films 15 are laminated together to form the first leading electrodes 25. Each of these electrodes 25 except both end ones is connected to one of the piezoelectric actuator electrodes 35 and 36. It is therefore possible to form the leading electrodes 25 in the body 1 integrally with it, thereby protecting them securely from damage and breakage or disconnection.

The films 16 for the second leading electrodes 26 are formed in the upper green sheets 12. The drive IC 46 for driving the piezoelectric actuators is connected to the leading electrodes 25 and 26. Therefore, when the IC 46 is mounted on the head body 1, the IC 46 can be connected to the electrodes 25 and 26 at the same time. Because the IC 46 is mounted on the body 1, the heat generated in the IC 46 by the ink ejection operation is transferred efficiently to the body 1. Therefore, the heat of the IC 46 can be radiated effectively. In the meantime, the radiated heat heats the ink in the passages 32, thereby lowering the ink viscosity. This improves the ink ejection performance of the recording head 45.

Formed in the head body 1 are the second leading electrodes 26 for connecting the drive IC 46 to the wiring pattern on the printed board 48 positioned outside the recording head. The third terminals 29, which are each connected to one of these electrodes 26, are exposed in the top surface of the body 1. The signal conductors of the FPC 47, which are connected through the second leading electrodes 26 to the input terminal area of the IC 46, are several for the data and control signals etc. It is therefore possible to simplify the electrical connection between each third terminal 29 and the wiring pattern on the board 48.

The recording head 45 might be modified in such a manner that the third terminals 29 might be formed in the rear end of the head body 1. In this case, when the rear end of the head 45 is fitted to the printed board 48, these terminals 29 are connected to the wiring pattern on the board 48 at the same time by brazing, wire bonding or the like. This omits the FPC 47.

The invention can be applied to ink-jet recording heads, which includes a head for ejecting ink by producing bubbles thermally, and to various processes for making such heads.

A recording head according to the invention may be applied to an ink jet printer as disclosed in U.S. Pat. No. 5,639,220, the disclosure of which is incorporated herein by reference.

What is claimed is:

1. An ink jet print head comprising:

a head body having nozzles;

ink passages formed in the body to be filled with ink, the passages each communicating with one of the nozzles; and pizoelectric actuators, each for changing a volume of one of the passages to eject ink from the associated nozzle, the actuators being made of laminated sheets and including leading electrodes which extend through a thickness of the laminated sheets and contact the piezoelectric actuators with a drive circuit, wherein the leading electrodes are formed by laminating a plurality of sheets together in which predetermined areas are replaced with material that forms the leading electrodes.

2. The print head defined in claim 1, wherein one end of each of the leading electrodes is exposed to the outside of the head body.

3. The print head defined in claim 2, wherein the drive circuit is mounted on the head body in such a manner that the drive circuit covers exposed ends of the leading electrodes, the drive circuit being connected to the exposed ends of the electrodes.

4. The print head defined in claim 3, further comprising second leading electrodes embedded in the head body for connecting the drive circuit to an electric system outside of the print head, one end of each of the second electrodes being exposed to the outside of the head body.

5. The print head defined in claim 4, wherein the other end of each of the second leading electrodes is exposed to the outside of the head body and connected to the drive circuit.

6. The print head defined in claim 1, further comprising electrodes formed on inner walls of the ink passages for driving the piezoelectric actuators.

7. The ink jet print head defined in claim 1, wherein the leading electrodes extend perpendicular to each of the laminated sheets.

8. An ink jet printer comprising a print head and a device for supplying the head with ink, the head including:

a head body having nozzles;

ink passages formed in the body to be filled with ink, the passages each communicating with one of the nozzles; and piezoelectric actuators each for changing the volume of one of the passages to eject ink from the associated nozzle, the actuators being made of laminated sheets including leading electrodes which extend through a thickness of the laminated sheets and connect the piezolectric actuators with a drive circuit, wherein the leading electrodes are formed by laminating a plurality of piezolectric sheets together in which predetermined areas are replaced with material that forms the leading electrodes.

9. The ink jet printer defined in claim 8, wherein one end of each of the leading electrodes is exposed to the outside of the head body.

10. The ink jet printer defined in claim 9, wherein the drive circuit is mounted on the head body in such a manner that the drive circuit covers exposed ends of the leading electrodes, the drive circuit being connected to the exposed ends of the electrodes.

11. The ink jet printer defined in claim 8, wherein the leading electrodes extend perpendicular to each of the laminated sheets.

12. An ink jet print head comprising:

a head body having nozzles;

ink passages formed in the body to be filled with ink, the passages each communicating with one of the nozzles; and piezoelectric actuators, each for changing a volume of one of the passages to eject ink from the associated nozzle, the actuators being made of laminated sheets and including driving electrodes which apply a voltage to the actuators to deform the actuators so as to change the volume and leading electrodes which extend through a thickness of the laminated sheets in a direction perpendicular to a direction in which the actuators deform and connect the driving electrodes with a drive circuit.

13. An ink jet print head comprising:

a head body having nozzles;

ink passages formed in the body to be filled with ink, the passages each communicating with one of the nozzles; and piezoelectric actuators, each for changing a volume of one of the passages to eject ink from the associated nozzle, the actuators being made of laminated sheets and including driving electrodes which extend parallel to a direction of the depth of the passages and apply voltage for driving the actuators to the actuators and leading electrodes which extend through a thickness of the laminated sheets and connect and the driving electrodes with a drive circuit.

* * * * *